United States Patent [19]

Levitt et al.

[11] 3,975,625

[45] Aug. 17, 1976

[54] ELECTRONIC COORDINATE TRANSFORMATION USING MULTIPLIER CIRCUITS

[75] Inventors: Barry N. Levitt, Framingham; Thomas H. Crocker, Burlington; Everett E. Chapman, Ipswich, all of Mass.

[73] Assignee: The United States of America as represented by the Secretary of the Air Force, Washington, D.C.

[22] Filed: Jan. 16, 1975

[21] Appl. No.: 541,485

[52] U.S. Cl. ..... 235/189; 235/186; 235/150.25

[51] Int. Cl.[2] ..... G06G 7/22

[58] Field of Search ..... 235/186, 189, 194, 150.25, 235/150.26, 150.27; 318/648, 649, 661

[56] References Cited

UNITED STATES PATENTS

| | | | |
|---|---|---|---|
| 2,927,734 | 3/1960 | Vance | 235/189 |
| 3,457,394 | 7/1969 | Grado | 235/189 |
| 3,558,863 | 1/1971 | Williams, Jr. et al. | 235/189 X |
| 3,694,631 | 9/1972 | Cushman | 235/186 X |
| 3,710,087 | 1/1973 | Siegel | 235/189 |

*Primary Examiner*—Joseph F. Ruggiero
*Attorney, Agent, or Firm*—Joseph E. Rusz; William Stepanishen

[57] ABSTRACT

An electronic coordinate transformation network using multiplier circuits for mechanizing and solving the equations relating the vectors of one coordinate system to those of another coordinate system.

2 Claims, 2 Drawing Figures

ELECTRONIC COORDINATE TRANSFORMATION USING MULTIPLIER CIRCUITS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to coordinate transformation system utilizing multiplier circuits.

In the prior art, circuits for coordinate transformation systems utilized electro-mechanical rotary transducers or resolvers. The use of resolvers for performing coordinate transformations required a multiplicity of resolver units to provide multiple transformations. As the number of electromechanical devices in a circuit increases, the reliability of the circuit decreases. This is largely due to the fact that mechanical wear, friction and the deterioration which is associated with resolvers, contributes to lower circuit reliability. Additionally, the electro-mechanical resolver concept for a coordinate transformation system is a digital mechanization which requires more complex conversion and timing circuitry. The present invention which is analog in nature, inherently has greater reliability, presents packaging versatility, uses less power and provides multiple transformation capabilities.

SUMMARY OF THE INVENTION

The present invention utilizes multiplier circuits to mechanize and solve complex vector equations for providing signal transfer from one coordinate system to another. The electronic coordinate transformation apparatus accepts two electronic input signals representing motion in one coordinate system and transforms these signals to indicate that same motion in a different coordinate system. This is accomplished by using the equations from one coordinate frame to the other. Multiplier circuit elements are used to mechanize the non-linear equations.

It is one object of the invention, therefore, to provide an improved electronic coordinate transformation apparatus having a high degree of reliability and reduced power consumption.

It is another object of the invention to provide an improved electronic coordinate transformation apparatus which is analog in nature thereby requiring less complex conversion circuitry.

It is still another object of the invention to provide an improved electronic coordinate transformation apparatus capable of performing multiple transformations with greater accuracy and versatility.

These and other advantages, features and objects of the invention will become more apparent from the following description taken in connection with the illustrative embodiment in the accompanying drawings.

DESCRIPTION OF THE PREFERRED EMBODIMENT

Figure 1:
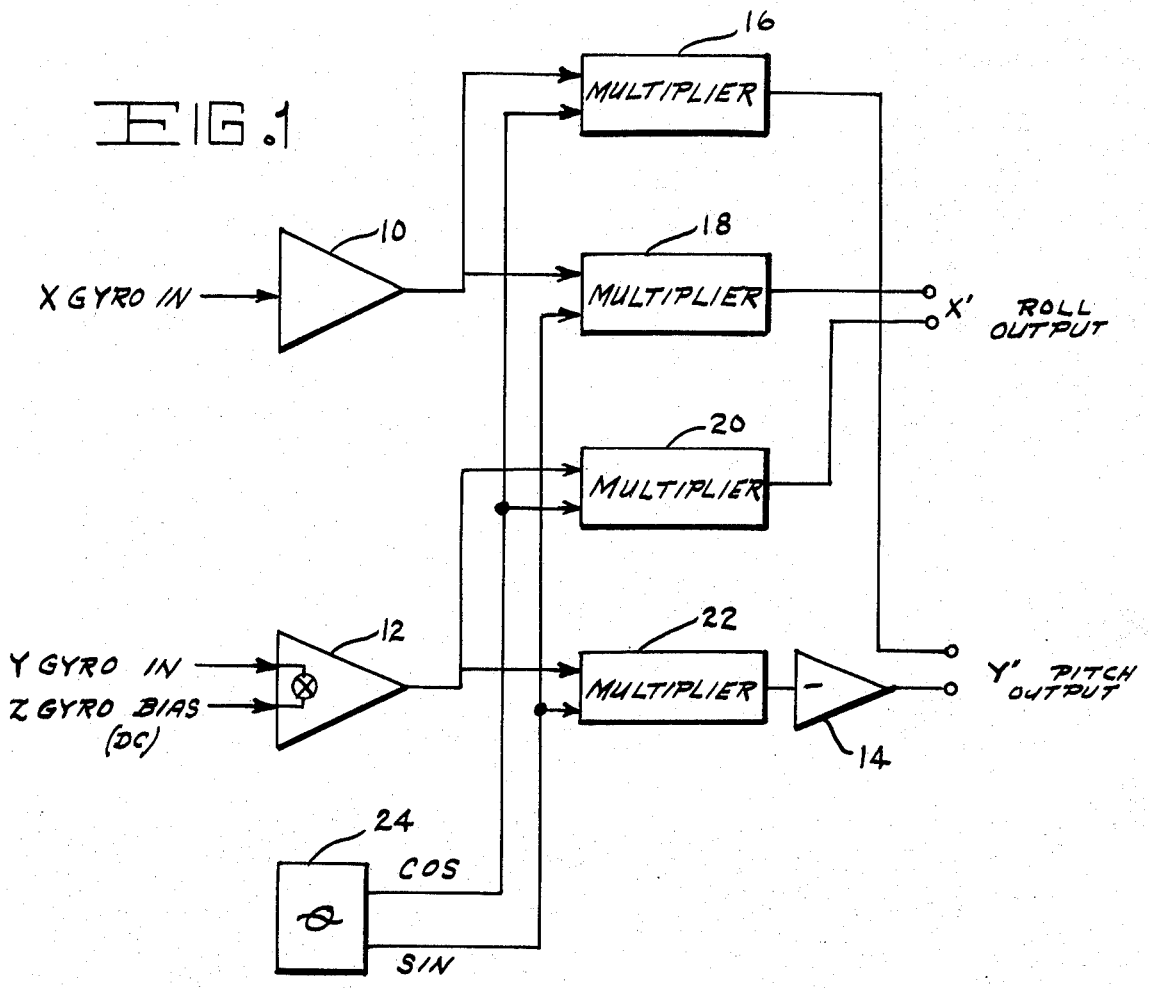
FIG. 1 is a block diagram of the electronic coordinate transformation apparatus in accordance with the present invention.

Referring now to FIG. 1, there is shown a block diagram of an electronic coordinate transformation apparatus comprising three operational amplifiers 10, 12, 14 and four multiplier units 16, 18, 20, 22. The operational amplifier 10 receives the signal from the x gyro and the operational amplifier 12 receives the Z gyro bias and Y gyro signals. The operational amplifier 14 which is connected to the output of multiplier 22 performs a signal inversion process. Angle unit 24 supplies the angle information, $\theta$, with respect to the transformation coordinate system pair to multiplier units 16, 18, 20, 22. The output signals from the operational amplifier 10, 12, are respectively applied to multiplier units 16, 18, 20, 22 as shown in FIG. 1.

Figure 3:
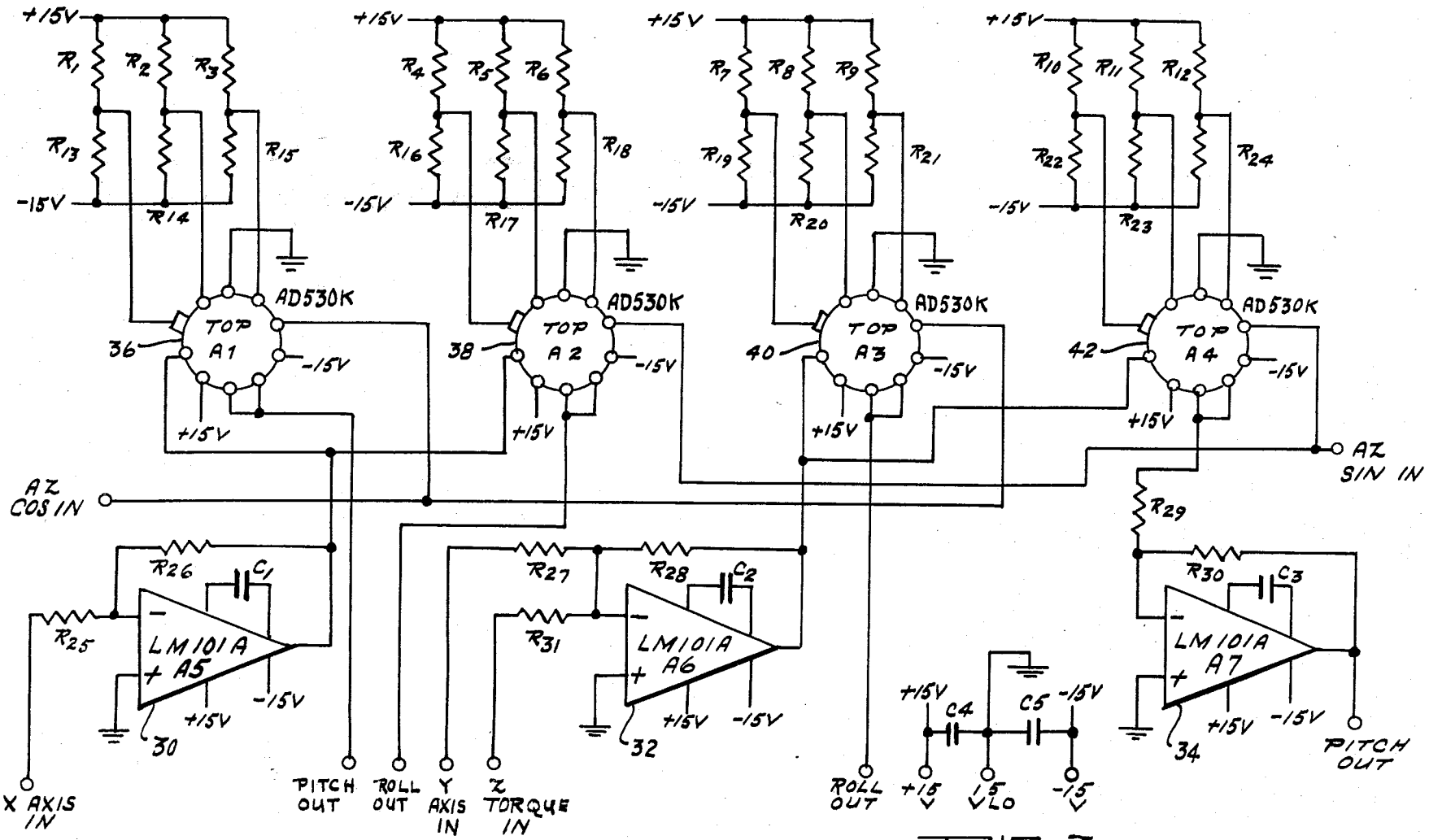

Turning now to FIG. 3, there is shown a schematic diagram for the circuit of FIG. 1 utilizing LM101A operational amplifiers 30, 32, 34 and four AD530k multipliers units 36, 38, 40, 42 with their associated circuitry. The operational amplifiers 30, 32, 34 are used to sum bias or control signals into the stabilization loop (not shown) or to provide the signal inversion necessary in mechanizing the transformation equations. In each case, the operational amplifiers function as simple amplifiers having unity gains. The multipliers 36, 38, 40, 42 are integrated circuits which are manufactured by Analog Devices, Maynard, Mass, are used in the standard form for multipliers as specified by the supplier. The resistor bias networks, associated with each multiplier unit serve to set the multiplier outputs to null for zero input. The transfer function of the multiplier unit is XY/10, where X and Y are the two inputs to be multiplied. In the present circuit it is desirable to multiply an AC signal by a DC signal. This method minimizes DC bias drifts and eliminates frequency doubling characteristics obtained from multiplying two AC signals. The X and Y axis inputs are therefore demodulated prior to use in the circuit, while the AZ sin and cos signals are maintained as AC inputs.

Figure 2:
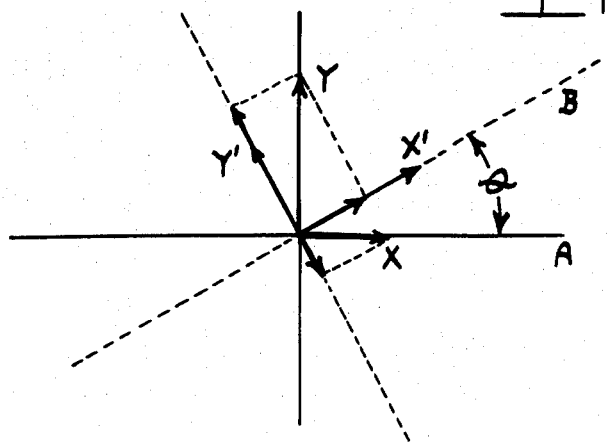
FIG. 2 is a graphic representation illustrating the transformation vector relationships, and, FIG. 3 is a schematic diagram of the electronic coordinate transformation apparatus of FIG. 1.

The circuit elements which are necessary to mechanize the electronic coordinate transformation circuit have been shown in FIGS. 1 and 3 as four analog multipliers, with associated circuitry, an inverting operational amplifier and two operational amplifiers to accept the input signals shown. These units are arranged as shown in FIGS. 1 and 3 to process the transformation equations which are given below.

$$X^1 = X \cos\theta + Y \sin\theta \quad (1)$$

$$Y^1 = -X \sin\theta + Y \cos\theta \quad (2)$$

where $X$ and $Y$ are the input signals, $X^1$ and $Y^1$ are the output signals, and $\theta$ is the angle with which coordinate system B has rotated with respect to coordinate system A. These parameters which illustrate the transformation vector relationships are graphically presented in FIG. 2. It may be seen that the vector relationships which are described in equations (1) and (2) represent a direct transformation from one coordinate system to another which has been rotated by any angle about their common orthogonal axis.

The specific characteristics of the signals X, Y, $X^1$, $Y^1$, Sin $\theta$ and Cos $\theta$ are dependent on the particular application involved, but the multiplier network input should be maintained as one AC, phase sensitive, and one DC signal to avoid DC bias uncertainties and AC rectification problems. The outputs from the multipliers will, therefore, be phase sensitive AC signals with carrier frequencies equal to that of the multiplier AC inputs.

This section describes the results of test conducted to verify the operation of the electronic coordinate transformation using multiplier units. The tests demonstrated the operation of the electronic coordinate transformation apparatus and its effects on system performance. Particular interest was given to gimbal loop stability, crosscoupling operation through full 360° range, output signal characteristics, and circuit reliability.

The multiplier and amplifier components were tested and preset to proper bias values. The network was then integrated with an inertial platform. System interfaces included two gyro pickoff signals which represented angular motion about orthogonal axes. These were 500 Hz AC signals (X and Y in equations (1) and (2), which were demodulated. The other inputs were the sine and cosine outputs which indicated the angular position of the gimbal ($\theta$) which contained the gyros with respect to the other gimbals. These were maintained as 500 Hz AC signals containing phase information. The outputs from the electronic coordinate transformation apparatus were used as the input to stabilization amplifiers which provided signals to control the two outside gimbals through torque motors.

After preliminary phasing checks and gain adjustments, the gimbal loops were closed. The loop stability was acceptable as checked by several instantaneous loop captures and by manual handling of the controlled gimbals. The cross coupling effects were investigated by manually inserting inputs along a gyro input axis and then monitoring the output of the coordinate transformation network with the inner gimbal in various positions to see if the proper output was obtained. The outputs were compared with those from a parallelled coordinate transformation resolver and found to exhibit cross coupling of less than 3 percent due to the electronic transformation. This is negligible in most applications.

With all three gimbal loops inertially controlled by their respective gyros, the case of the platform was rotated through 360° about the inner gimbal. This represented a rotation of the coordinate reference frame and, therefore, a change in $\theta$ from 0° to 360°. The loop stability, stiffness and inertial characteristics were monitored throughough the rotation. The stability was measured by manually displacing the gimbals, by about 6 minutes, at each 45° point of the rotation. In each case stability was obtained and transients disappeared within one second. The stiffness was measured to be $0.12 \pm 0.002$ milliradians per oz — inch at each 45° point of the rotation. The inertial platform showed little change in its loop characteristics due to inner gimbal rotations.

The outputs from the transformation network were monitored on an oscilloscope to analyze their signal characteristics. They had phase shifts of less than 1.2 degrees with respect to the reference signal. They showed less than 10 millivolts noise and less than 5 percent distortion throughout the range of operation. This performance is equivalent to or better than obtainable from conventional transformation resolver approaches.

What is claimed is:

1. An electronic coordinate transformation apparatus comprising in combination:

a plurality of analog control units to receive input coordinate signals, wherein said plurality of analog control units comprise a first and second operational amplifier, said first operational amplifier receiving a first input coordinate signal, said second operational amplifier receiving a second input coordinate signal, said first and second operational amplifiers being connected to said plurality of analog signal processing units, and a plurality of analog signal processing units connected to said plurality of analog control units to process said input coordinate signals, said plurality of analog signal processing units connected to receive orientation signals, said plurality of analog processing units combining said input coordinate signals and orientation signals to provide output transformation signals, wherein said plurality of analog signal processing units comprise a first, second, third and fourth multiplier units, said first and second multiplier units respectively receiving the output from said first operational amplifier and a first orientation signal, said third and fourth multiplier units respectively receiving the output from said second operational amplifier and a second orientation signal, said first, second, third and fourth multiplier units respectively combining the applied input signals, said first and fourth multiplier units providing a first output transformation signal, said second and third multiplier units respectively providing a second output transformation signal.

2. An electronic coordinate transformation apparatus as described in claim 1 wherein said first output transformation signal represents the roll signal and said second output transformation signal represents the pitch signal.

* * * * *